United States Patent [19]

Ripka

[11] Patent Number: 4,467,780

[45] Date of Patent: Aug. 28, 1984

[54] HIGH EFFICIENCY CLAMSHELL HEAT EXCHANGER

[75] Inventor: Chester D. Ripka, E. Syracuse, N.Y.

[73] Assignee: Carrier Corporation, Syracuse, N.Y.

[21] Appl. No.: 378,583

[22] Filed: May 17, 1982

Related U.S. Application Data

[63] Continuation of Ser. No. 33,588, Apr. 26, 1979, abandoned, which is a continuation of Ser. No. 828,790, Aug. 29, 1977, abandoned.

[51] Int. Cl.[3] ..... F24H 3/08

[52] U.S. Cl. ..... 126/110 R; 126/91 A; 126/116 R

[58] Field of Search ..... 126/110 R, 110 B, 116 R, 126/91 A; 165/146, 147

[56] References Cited

U.S. PATENT DOCUMENTS

| | | | |
|---|---|---|---|
| 2,247,849 | 7/1941 | Ritter | 126/116 R |
| 2,504,315 | 4/1950 | Feuerfile | 126/110 R |
| 3,073,296 | 1/1963 | Hollingsworth et al. | 126/110 R |
| 3,140,706 | 7/1964 | Block et al. | 126/110 R |

*Primary Examiner*—William E. Tapolcai, Jr.
*Attorney, Agent, or Firm*—David L. Adour

[57] ABSTRACT

A high efficiency induced draft clamshell type heat exchanger for use in a hot air furnace. The geometry of the heat exchanger is such that the various segments are compactly arranged to transfer heat from the fuel to the air passing over the heat exchanger surface while maintaining the discharged products of combustion at a temperature sufficiently high to prevent condensation from forming or collecting within the heat exchanger during steady state operation.

11 Claims, 31 Drawing Figures

HIGH EFFICIENCY CLAMSHELL HEAT EXCHANGER

This application is a continuation, of application Ser. No. 033,588, filed 4-26-79, now abandoned, which is a continuation of U.S. Ser. No. 828,790, filed 8-29-77 now abondoned.

BACKGROUND OF THE INVENTION

1. Field of the Invention

The present invention relates to heat exchangers for use in a hot air furnace. More specifically the present invention relates to heat exchangers for use in a gas fired, hot air furnace, said heat exchangers being principally adapted to be fired by a fuel burner and further being adapted to be fired under a suction pressure created by an induction draft blower.

2. Description of the Prior Art

Heat exchangers of the type commonly used for gas fired hot air furnaces are found in many residential and commercial installations. In particular compact furnaces adapted to be used either in the basement or some other small or confined area in the house have long used clamshell type heat exchangers to heat room air being passed over the surface of the exchanger. This room air is then circulated within the area to be heated and simultaneously cold air is removed from the area to be heated and recirculated through the furnace. A series of heat exchangers are provided in each furnace depending upon the size of the space or structure to be heated. It has become an industry practice to provide heat exchangers of a pre-selected capacity so that multiples of the heat exchanger may be provided together in a single furnace to reach the appropriate furnace capacity.

Commercial installations often involve a roof top unit to avoid using valuable floor space for heating and ventilating equipment. The size of commercial units is generally limited by cost and shipping requirements. A series of heat exchangers of a pre-selected capacity are usually provided for each roof top unit so that multiples of the heat exchanger may be used to obtain the desired furnace capacity.

Previous heat exchangers have been constructed from two metal sheets such that a fluid flow path is created when the two sheets are asembled. This type of heat exchanger is known as the clamshell type since it is constructed from two separate sheets, usually of metal. Typically a single burner is used to provide heat to the inlet side of the heat exchanger and the products of combustion are removed from the heat exchanger either using an induction draft blower or by convection.

The furnace industry has developed numerous clamshell heat exchangers, the bulk of which appear to have an efficiency of about 75%, efficiency referring to the portion of heat contained in the fuel transferred to the air passing over the heat exchanger. These previous heat exchangers have had various forms including a serpentine form as disclosed in Raleigh, U.S. Pat. No. 3,661,140, a "lamb chop" arrangement as disclosed in Block et al., U.S. Pat. No. 3,140,706, a curvilinear heat exchanger as disclosed in Norris, U.S. Pat. No. 3,294,082, and the other prior art disclosed therein. Other types of heat exchanger configurations can be found in Wilhoite et al., U.S. Pat. No. 3,111,940; and Jaye et al., U.S. Pat. No. 2,808,047; Hollingsworth, U.S. Pat. No. 3,073,296; Peoples et al., U.S. Pat. No. 3,084,682; Reznor, U.S. Pat. No. 3,241,609; Rutherford, U.S. Pat. No. 3,527,292; and Brown, U.S. Pat. No. 1,931,247.

Since the advent of the natural gas shortage of the winter of 1976-1977 and the general awareness of the lack of unlimited natural gas supplies especially the lack of unlimited amounts of natural gas for residential usage and more particularly since many major utilities have now limited new installations of natural gas consuming appliances it has been deemed desirable to develop a highly efficient heat exchanger both for use in a compact residential furnace and for commercial furnace purposes. To resolve the problem of finding a highly efficient heat exchanger the hereinafter described configuration was invented. This new induced draft clamshell type heat exchanger has experimentally been found to be 84% efficient as compared to the 75% efficiency industry produced heat exchanger presently in use.

SUMMARY OF THE INVENTION

An object of the present invention is to transfer heat from a fuel to air for heating an area with a maximum of practical effeciency.

Another object of the present invention is to provide a heat exchanger in which the heat from the fuel will be transferred to the air for heating purposes while maintaining an exit gas temperature sufficiently high to avoid condensation being formed within the heat exchanger during operation.

A more specific object of the present invention is to form both a straight through and a compact four pass heat exchanger for use in existing furnaces while increasing the efficiency thereof.

Another object of the present invention is to provide a highly efficient yet inexpensive to manufacture heat exchanger for use in a hot air furnace.

A still further object of the present invention is to manufacture a heat exchanger having a relatively constant surface temperature over much of its area to prevent the buildup of internal stresses due to the heating and cooling from cycling of the furnace in which the heat exchanger is used.

A still further object of the present invention is to provide a heat exchanger having its surfaces maintained in such a configuration that upon heating and cooling the flow path will not be restricted by the movement of the surface.

A still further object of the present invention is to maintain a high fluid velocity through a narrow portion of the heat exchanger to maximize the heat transfer from the combustion products within the heat exchanger to the air to be heated passing over the heat exchanger.

Other objects will be apparent from the description to follow and from the appended claims.

The preceding objects are achieved according to one embodiment of the invention by the provision of a four pass clamshell type heat exchanger. A compact heat exchanger having an entry portion adapted to receive the fuel and admixed air from the burner, a combustion portion wherein the bulk of the fuel is combusted, a reducing portion in which the generally elliptical cross section of the heat exchanger converges along the flow path, a transition portion in which the cross section of the heat exchanger element is transformed from one that is generally elliptical to one that is generally rectangular in shape, a level portion in which the thickness of the heat exchanger remains relatively constant and an exit portion to which the now cooled combustion products are exhausted from the heat exchanger. The internal configuration of the heat exchanger is so arranged that in the reducing portion of the heat exchanger the surface temperature of the heat exchanger is relatively constant. The level portion of the heat exchanger is further arranged such that the combustion products will travel with sufficient velocity to transfer all of the usable heat to the air flowing over the heat exchanger while maintaining an exit gas temperature sufficiently high to prevent condensation from collecting within the heat exchanger during operation.

BRIEF DESCRIPTION OF THE DRAWINGS

FIG. 15 is omitted.

DESCRIPTION OF THE PREFERRED EMBODIMENTS

The embodiments of the invention describe below are adapted for use in either a compact residential hot air furnace or a commercial roof top furnace although it is to be understood the invention defines like use in other furnace units. The heat exchanger described below is adapted for use either by itself or in combination with a series of other heat exchanger elements. Furthermore, the heat exchanger as hereinafter described will be of a particular configuration but it is to be understood that variations of that configuration are included within the scope of this invention. More specifically variations in the arcs formed by the curved portions, whether or not the straight portions are parallel, the particular cross section dimensions of the various portions of the heat exchanger, the number of straight sections or curved sections, or in general many of the specific details hereinafter described may be altered without adversely effecting the overall design and efficiency of the heat exchanger.

Figure 1:
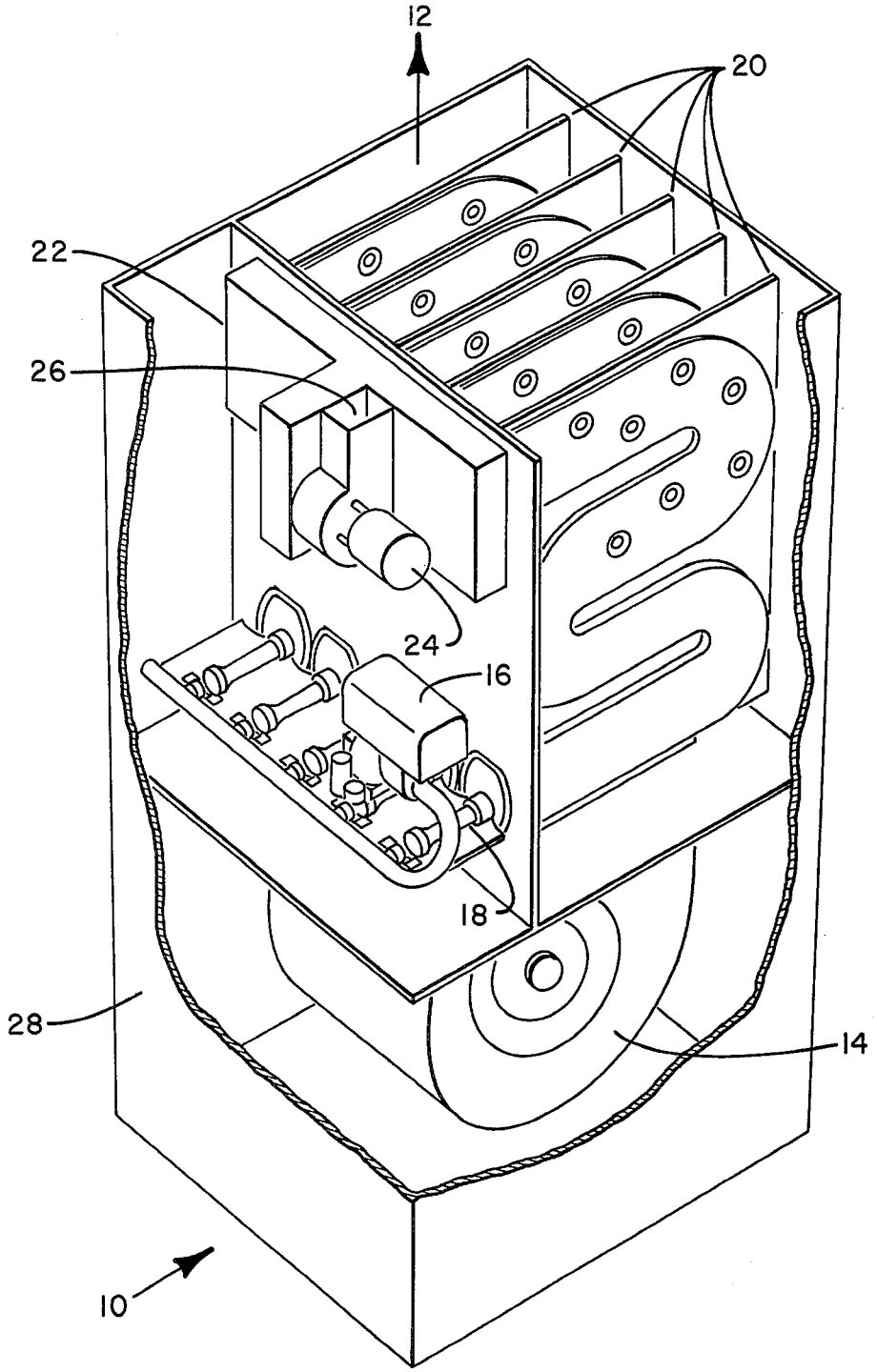
FIG. 1 is an orthographic view of a hot air furnace in which are mounted five heat exchangers per the disclosed invention.

Referring now to the drawings. FIG. 1 shows an orthographic view of a typical compact hot air furnace 10. Therein the furnace 10 has a sheet metal outer covering 28 which encases a series of five heat exchangers 20, blower 14, burners 18, one for each heat exchanger and gas and pressure regulator 16. Burners 18 are so arranged that they receive natural gas from the gas and pressure regulator 16. This gas is injected by burner 18 into the open end of heat exchanger 20. As a part of the injection process air is drawn into the heat exchanger so that the gas and the air may be combusted within the heat exchanger. Header 22 connected to the exhaust portion of each of the heat exchangers is also connected to induction draft unit 24 which creates a suction pressure through the heat exchangers to exhaust the discharge gases resulting from combustion through opening 26 to the discharge flue. Blower 14 receives cold room air from the area which is to be heated, forces that air over the heat exchanger surfaces in the direction indicated by arrow 12 and said air is then collected and returned to the rooms to be heated (the collection and return of the air not being shown). Since the induction draft blower 24 is only operated when the furnace is being fired by the burners, the blower serves to impede exhaust gases from exiting the furnace after shutdown performing a similar function as a flue damper.

Figure 2:
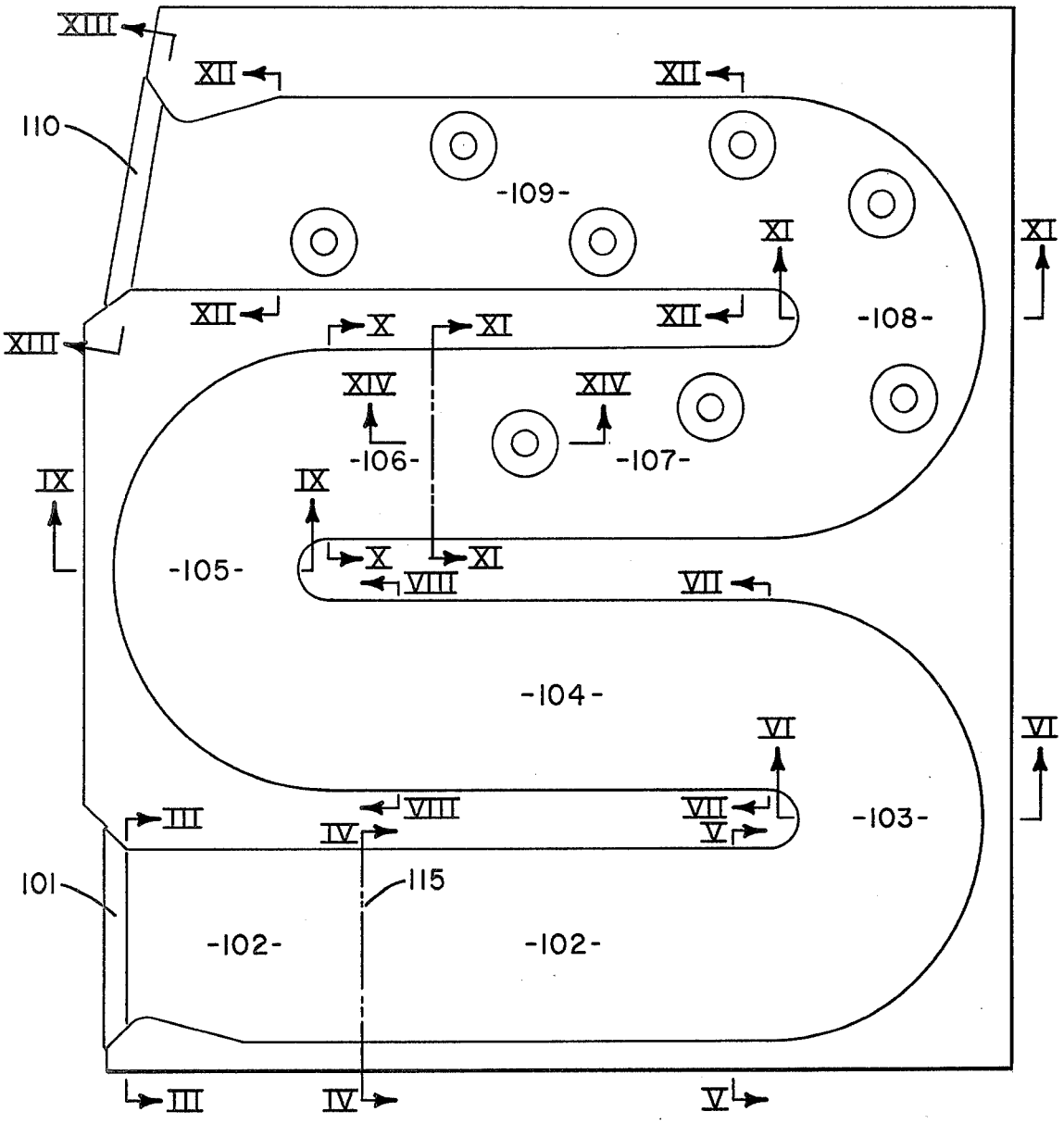
FIG. 2 is a side elevational view of an embodiment of a four pass heat exchanger.
Figure 3:
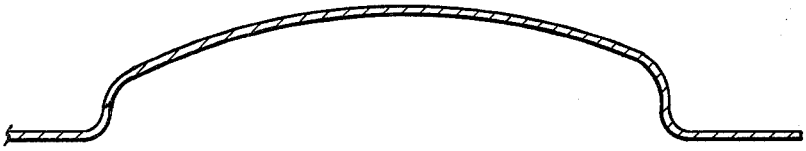
FIG. 3 is a cross section of FIG. 2 taken at line III—III.
Figure 4:
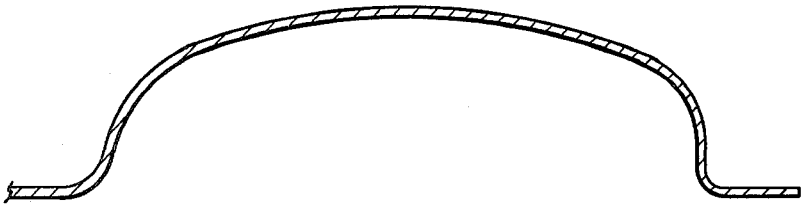
FIG. 4 is a cross section of FIG. 2 taken at line IV—IV.
Figure 5:
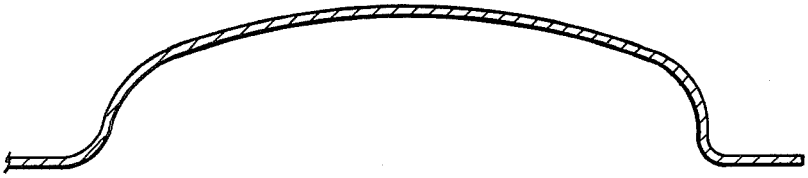
FIG. 5 is a cross section of FIG. 2 taken at line V—V.
Figure 6:
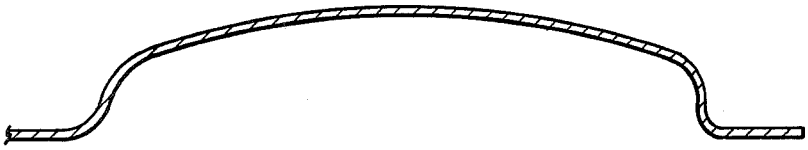
FIG. 6 is a cross section of FIG. 2 taken at line VI—VI.
Figure 7:
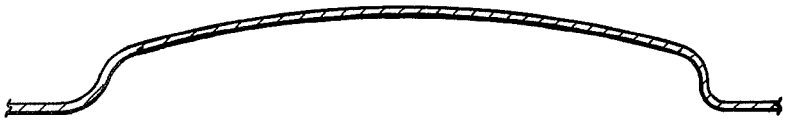
FIG. 7 is a cross section of FIG. 2 taken at line VII—VII.
Figure 8:
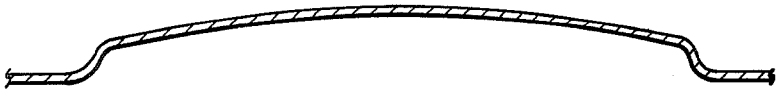
FIG. 8 is a cross section of FIG. 2 taken at line VIII—VIII.
Figure 9:
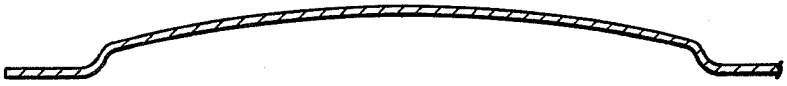
FIG. 9 is a cross section of FIG. 2 taken at line IX—IX.
Figure 10:
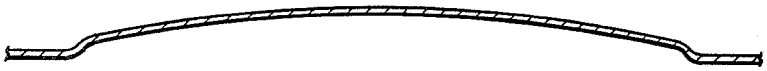
FIG. 10 is a cross section of FIG. 2 taken at line X—X.

FIG. 2, an elevational view of the heat exchanger element, discloses the various portions of the heat exchanger 20 when shown in the embodiment of a four pass unit. The gas and air mixture from the burners enters the heat exchanger through entry portion 101. Entry portion 101 is located in registration with the burner so that there is a smooth flow of both fuel and air into the heat exchanger. Combustion portion 102 of the heat exchanger connected to portion 101 is the area in which the bulk of the fuel is combusted with the air to provide heat, both radiant and convectant. Combustion portion 102 is generally elliptical in cross section as is entry portion 101 and increases in cross sectional thickness from the juncture of combustion portion 102 with entry portion 101 to cross section line IV—IV which indicates the thickest point of the heat exchanger. Thereafter combustion portion 102 gradually converges in cross sectional thickness. Connected to combustion portion 102 is a first curved portion 103 elliptical in cross section and generally converging in cross sectional thickness.

Connected to first cuved portion 103 is first straight portion 104 elliptical in cross section and generally converging in cross sectional thickness along the flow path of the products of combustion from entry into the heat exchanger to discharge from the heat exchanger. Connected to the first straight portion 104 is second curved portion 105 also generally elliptical in cross section and decreasing in cross sectional thickness. Transition portion 106 is connected to second curved portion 105 and at their intersection is generally elliptical in cross section and at the other end of transition portion 106, said portion is generally rectangular in cross section.

Second straight portion 107 is connected to transition portion 106 is generally rectangular in cross section and has a relatively constant cross sectional thickness. The third curved portion 108 is connected to second straight portion 107 and has a generally rectangular cross section of increasing thickness along the flow path. The third straight portion 109 is generally rectangular in cross section and relatively constant in thickness and is also connected to the third curved portion 108. Exit portion 110 is connected to the third straight portion 109 is generally rectangular in cross section and a relatively constant thickness. Exit portion 110 is adapted to be connected to the induction draft header from which the combustion products are exhausted from the heat exchanger.

Figure 11:
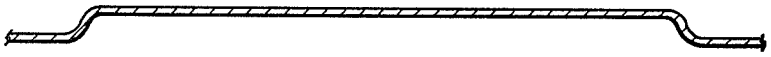
FIG. 11 is a cross section of FIG. 2 taken at line XI—XI.
Figure 12:
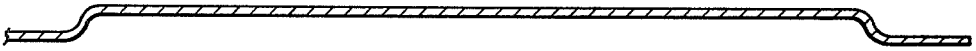
FIG. 12 is a cross section of FIG. 2 taken at line XII—XII.
Figure 13:
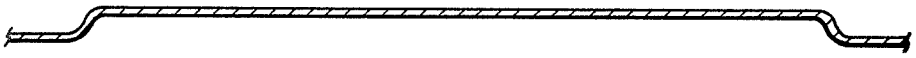
FIG. 13 is a cross section of FIG. 2 taken at line XIII—XIII.
Figure 14:
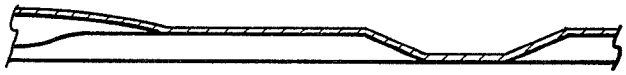
FIG. 14 is a cross section of FIG. 2 taken at line XIV—XIV.

FIGS. 3, 4, 5, 6, 7, 8, 9 and 10 all reflect elliptical cross sections having varying thicknesses and configurations depending upon the location within the heat exchanger. FIGS. 11, 12 and 13 all reflect cross sections having generally rectangular configurations of varying thicknesses depending on their position within the heat exchanger. FIG. 14 is a view of a portion of transition portion 106 showing the transition from an elliptical cross section to a rectangular cross section and the consequent narrowing in the thickness of the heat exchanger at that point. Furthermore dimples 30 as shown on FIG. 2 and as shown in cross section on FIG. 14 are provided within the rectangular cross sectional area portions of the heat exchanger.

A reducing section comprises the part of combustion portion 102 from point 115 to the junction of combustion portion 102 with first curved portion 103, first curved portion 103, first straight portion 104 and second curved portion 105. This reducing section is designed so that the cross sectional thickness is constantly converging along the flow path so that the flow of the products of combustion through the heat exchanger must constantly increase in velocity. This increase in velocity together with the combination of the decrease in temperature of the combustion products by the transfer of heat through the heat exchanger surfaces is designed to result in a relatively constant surface temperature throughout the reducing section. The advantage of having a relatively constant surface temperature is that upon heating of the unit on startup and on cooling of the unit after the burner is turned off, the reducing section will expand and contract uniformly, thereby limiting thermal stresses within the heat exchanger.

The level section of the heat exchanger, second straight portion 107, third curved portion 108, third straight portion 109, and exit portion 110, are all designed to have the narrowest practical thickness possible for the desired flow rate. This reduction in cross sectional area enables the combustion products to be accelerated so that the surface temperature of the heat exchanger is maintained as high as possible while the temperature of the combustion products is being reduced to that temperature just above the condensation point for the combustion products. In other words it is desirable to have the combustion products at the point of discharge at a temperature slightly higher than the temperature at which condensation will occur in the unit during the operation. Should condensation occur in the unit, the unit will be subject to the corrosive and other damaging forces due to condensate collection and the overall heat exchanger life will be greatly reduced.

The elliptical portions of the heat exchanger are designed with sufficient wall thickness that upon heating and cooling the convex half will expand outwardly thereby preventing any severe reduction in the cross sectional area of the heat exchanger at any specific point. The level section of the heat exchanger is provided with a plurality of dimples 30, each dimple being a depression in the heat exchanger surface designed to contact a similar depression in the opposite surface so that the heat exchanger surfaces are held apart thereby providing the minimum flow area desired.

The general direction of the flow of air over the heat exchanger surface is as shown by arrow 12 perpendicular to the direction of the flow path in the various straight portion, the second straight portion and the third straight portion. The various straight portions which intersect the direction of the air flowing over the heat exchanger are all connected by semicircular portions heretofore referred to as the first curved portion, the second curved portion and the third curved portion. It is to be understood that providing a series of heat exchanger portions perpendicular to the direction of flow of the air to be heated results in a maximum of heat transfer to the air to be heated for a given volume flow rate. Furthermore, the particular cross sectional configurations as shown in FIGS. 3–14 are designed to prevent any hot spots from occurring across the cross section of the various heat exchanger portions.

The dimples 30 have an additional function besides preventing collapse of the heat exchanger unit upon heating and cooling. These dimples further create obstacles within the air flow stream of the level section of the heat exchanger thereby creating mixing which further increase the velocity of the combustion products at that point. The heat exchanger herein described is furthermore capable of being mounted in any flow direction i.e. it may be mounted for horizontal or vertical burner input and upflow, downflow or across flow or any combination thereof of the air to be heated.

Figures 16, 17, 31, 32:
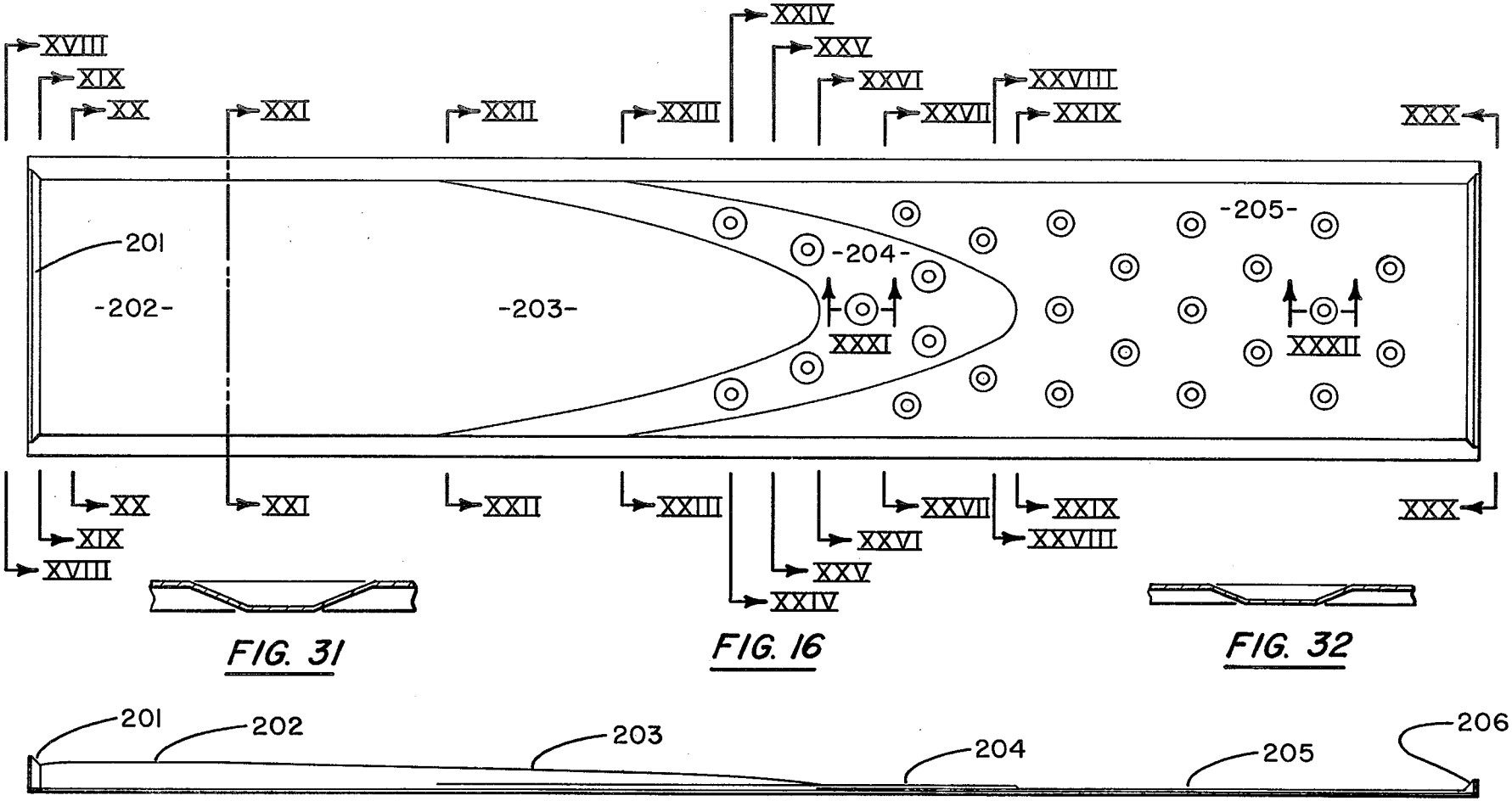
FIG. 16 is a side elevation view of a straight thru heat exchanger.
FIG. 17 is a top elevational view of the straight thru heat exchanger of FIG. 16.
FIG. 31 is a cross section of FIG. 16 at line XXXI—XXXI.
FIG. 32 is a cross section of FIG. 16 at line XXXII—XXXII.
Figure 18:
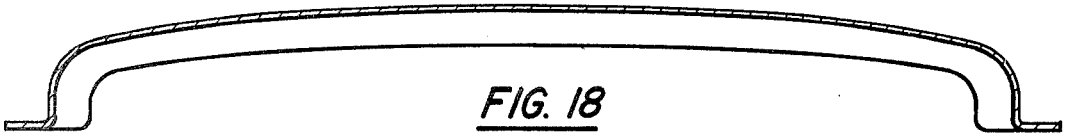
FIG. 18 is a cross section of FIG. 17 at line XVIII—XVIII.
Figure 19:
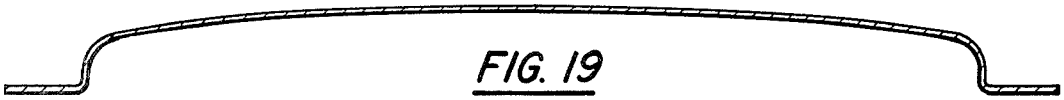
FIG. 19 is a cross section of FIG. 17 at line XIX—XIX.
Figure 20:
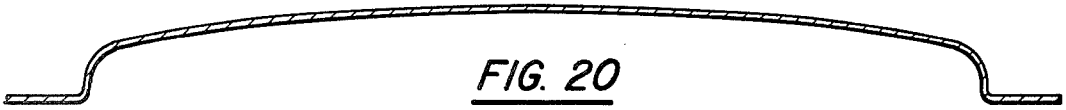
FIG. 20 is a cross section of FIG. 16 at line XX—XX.
Figure 21:
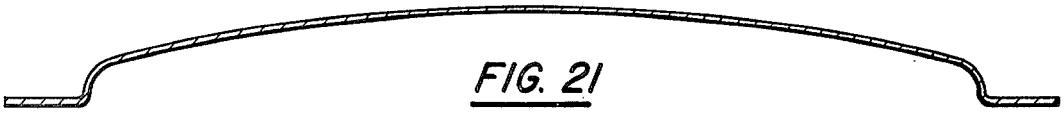
FIG. 21 is a cross section of FIG. 16 at line XXI—XXI.
Figure 22:
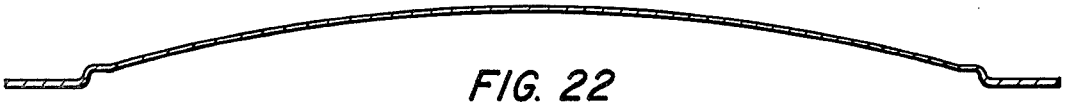
FIG. 22 is a cross section of FIG. 16 at line XXII—XXII.
Figure 23:
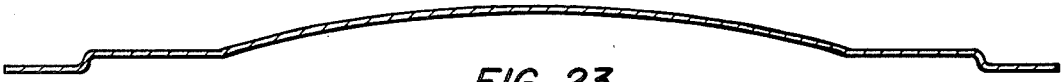
FIG. 23 is a cross section of FIG. 16 at line XXIII—XXIII.
Figure 24:
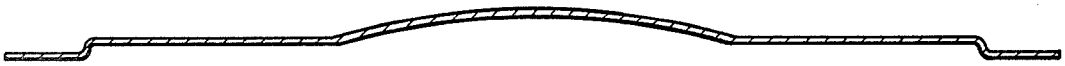
FIG. 24 is a cross section of FIG. 16 at line XXIV—XXIV.

Another embodiment of this invention, a straight thru heat exchanger is shown in FIGS. 16 and 17. This particular configuration is designed for a commercial furnace wherein the overall length of the heat exchanger is less critical than the size requirements for residential units. The straight thru heat exchanger is adapted to receive fuel and air from an in-shot type burner and is adapted to be connected to an induction draft blower to create a specific internal flow rate. Air to be heated is passed over the surface of the heat exchanger while the fuel and combustion air pass thru the heat exchanger.

Referring now to FIGS. 16 and 17 it can be seen that entry portion 201 is flared to receive the fuel and air for combustion, said portion being mounted in registration with the burner (not shown). Connected to entry portion 201 is combustion portion 202 having elliptical cross section of increasing or constant cross sectional thickness. Connected thereto is reducing portion 203 having an elliptical cross section of gradually decreasing cross sectional thickness.

Connected to reducing portion 203 is first level portion 204 wherein the cross section is transformed from a generally elliptical shape to a generally rectangular shape. Second level portion 205 having a constant thickness rectangular cross section is connected to the first level portion 204. Discharge portion 206 is flared and connected to second level portion 205, the discharge portion being adapted to be connected to an induced draft blower for drawing the fuel and air through the heat exchanger.

Figure 25:
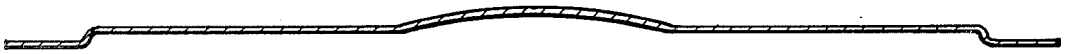
FIG. 25 is a cross section of FIG. 16 at line XXV—XXV.
Figure 26:
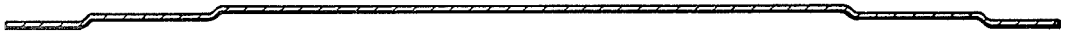
FIG. 26 is a cross section of FIG. 16 at line XXVI—XXVI.
Figure 27:
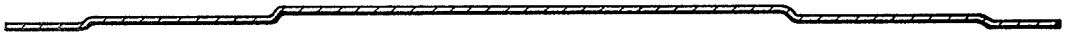
FIG. 27 is a cross section of FIG. 16 at line XXVII—XXVII.
Figure 28:
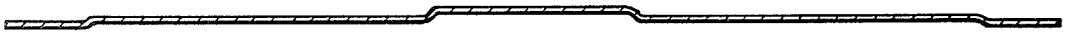
FIG. 28 is a cross section of FIG. 16 at line XXVIII—XXVIII.
Figure 29:
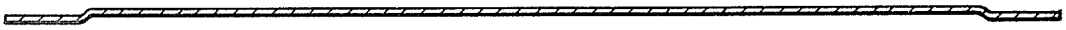
FIG. 29 is a cross section of FIG. 16 at line XXIX—XXIX.
Figure 30:
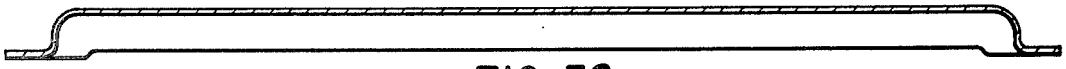
FIG. 30 is a cross section of FIG. 16 at line XXX—XXX.

As can be seen in FIGS. 16, 17, and 22-28 the transitions from the reducing portion 203 to the first level portion 204, and the first level portion 204 to the second level portion 205 are parabolic in shape. Hence a single cross section such as shown in FIG. 25 contains part of all three of these portions. Since in this transition area no portion extends fully across a section of the heat exchanger the reference to a portion being rectangular or elliptical in cross section applies only to that part of the cross section within the portion.

Both the first level portion 204 and the second level portion 205 have dimples 30 therein. Each half of the heat exchanger has the dimples so that upon heating and cooling the flow path of the heating fluid, fuel and air, will not be reduced in cross sectional area as a result of internal thermal stresses.

This straight thru embodiment provides for a relatively constant surface temperature in the reducing portion since the velocity of the heating fluid is increased to compensate for the transfer of heat to the heat exchanger. The overall cross sectional area in the first level portion is less than the least area part of the reducing portion to provide for a further increase in heating fluid velocity. The second level portion is of a yet smaller cross sectional area so that the velocity is further increased to the point at which the heating fluid leaving the heat exchanger is only slightly above the temperature at which condensate will form on the heat exchanger surfaces during operation.

Many modifications to the embodiments described above can be used with this invention. For example, altering the length of any particular portion, the thickness of any particular portion, the cross sectional configuration of any particular portion, the heat input or any of the other numerous factors involved results in only slight overall efficiency changes. These types of variations are contemplated within the spirit and the scope of this invention.

The invention has been described in detail the particular reference to two embodiments thereof, but it is to be understood that variations and modifications can be effected within the spirit and scope of the invention.

I claim:

1. A forced hot air heating furnace for raising the temperature of air being circulated through the furnace including a flue discharge opening which comprises:

an inshot burner for supplying a heating fluid including a combustible mixture of air and fuel;

an induced draft clamshell type heat exchanger adapted to be mounted in various orientations having an internal flow path for the transfer of heat energy from the heating fluid being combusted within the flow path to the air being circulated through the furnace in heat exchange relationship with the heat exchanger and being adapted to the inshot burner for receiving the heating fluid having:

(a) an entry portion located in registration with the burner for receipt of the heating fluid;

(b) a combustion portion connected to the entry portion, the combustion portion gradually increasing in thickness along the flow path to a point and then decreasing in thickness along the flue length and being generally elliptical in cross section and being that portion wherein the fuel is primarily combusted;

(c) a first curved portion connected to the combustion portion and having a generally elliptical cross section;

(d) a straight portion connected to the first curved portion and substantially parallel with the combustion portion and being generally elliptical in configuration;

(e) a second curved portion connected to the straight portion and being generally elliptical in cross section;

(f) a straight portion connected to the second curved portion being generally rectangular in cross section and being generally parallel to the combustion portion;

(g) a third curved portion connected to the straight portion and being generally rectangular in cross section;

(h) a straight portion being generally rectangular in cross section and being generally parallel with the combustion portion; and (i) an exit portion connected to the straight portion wherein a continuous flow path is provided for the heating fluid from the entry portion to the exit portion; and induced draft means mounted adjacent the exit portion of the heat exchanger for forcibly drawing the heating fluid through the flow path of the heat exchanger and for impeding the flow of gases through the flow path when the induced draft means is not being operated including impeding the flow of gases through the flue discharge opening to the flue.

2. The apparatus as set forth in claim 1 wherein the combustion portion, the first curved portion, the first straight portion and the second curved portion are all elliptical in cross section and are arranged with a decreasing cross-sectional thickness from the combustion portion through the second curved portion.

3. The apparatus as set forth in claim 1 wherein the clamshell heat exchanger further comprises a transition portion connected between the second curved portion and the second straight portion as part of the flow path of the heating fluid, said transition portion having an elliptical cross section at the end connected to the second curved portion and a rectangular cross section at the end connected to the second straight portion.

4. The apparatus as set forth in claim 1 wherein the second straight portion, the third curved portion and the third straight portion are all rectangular in cross section and of constant cross-sectional thickness.

5. The apparatus as set forth in claim 1 wherein the induced draft means is adapted to receive the heating fluid from the flow path and is connected to discharge said heating fluid to a flue means without mixing additional air with the heating fluid.

6. The apparatus as set forth in claim 1 wherein the induced draft means is located between the heat exchanger and a flue means for discharging the heating fluid, said draft means serving to impede flow through the heat exchanger and the flue means when the induced draft means is not energized.

7. A hot air heating assembly for raising the temperature of air being circulated in heat exchange relation with the assembly including a flue discharge opening which comprises:

a clamshell type heat exchanger formed from two sheets of material defining an internal flow path for conducting a heating fluid which may be combusted within the flow path to supply heat energy for raising the temperature of air being circulated in heat exchange relation with the assembly, said heat exchanger being capable of being mounted in various orientations and having;

(a) an entry portion for receipt of the heating fluid;

(b) a combustion portion connected to the entry portion being generally elliptical in cross section and gradually increasing in thickness along the flow path to a point and then decreasing in thickness and being that portion of the flow path wherein the heating fluid is primarily combusted;

(c) a reducing section connected to the combustion portion and being generally elliptical in cross section and having a decreasing thickness along the flow path;

(d) a transition portion connected to the reducing section and having the end of the transition portion adjacent the reducing section being generally elliptical in cross section and the end of the transition portion distant from the reducing section being generally rectangular in configuration;

(e) a level section connected to the transition portion having a generally constant cross-sectional thickness and being generally rectangular in cross section; and (f) an exit portion connected to the level section such that the various portions and sections of the heat exchanger define the heating fluid flow path from the entry portion to the exit portion;

an inshot burner arranged in registration with the entry portion of the heat exchanger to direct a stream of heating fluid into the combustion portion of the heat exchanger; and induced draft means arranged relative to the exit portion of the heat exchanger to forcibly draw the heating fluid through the flow path whereby the heat exchanger may be mounted in various orientations and said induced draft means serving to impede the flow of gases through the flow path and to impede the flow of gases out of the flue discharge opening when the induced draft means is not being operated.

8. The apparatus as set forth in claim 7 wherein the reducing section comprises a portion of the combustion portion, a first curved portion, a first straight portion generally parallel with the combustion portion and a second curved portion, all of said portions being generally elliptical in configuration.

9. The apparatus as set forth in claim 8 wherein the level section comprises a second straight portion, a third curved portion and a third straight portion, said second and third straight portions being generally parallel with the combustion portion.

10. The apparatus as set forth in claim 7 wherein the induced draft means is connected to a flue means for discharging the heating fluid after combustion and after it passes along the flow path, said induced draft means serving to impede the flow of air through the heat exchanger when the induced draft means is not energized.

11. The apparatus as set forth in claim 7 wherein the heating fluid transfers sufficient heat energy to the air being heated that the temperature of the heating fluid is sufficiently reduced that no air other than the original combustion air supplied as part of the heating fluid is necessary to cool the heating fluid before it is discharged from the air heating assembly.

* * * * *